US005949198A

United States Patent [19]

Nakamura et al.

[11] Patent Number: 5,949,198

[45] Date of Patent: Sep. 7, 1999

[54] LIGHT-EMISSION CONTROLLING APPARATUS

[75] Inventors: Kenji Nakamura, Tokyo; Yoshio Katayama, Hyogo; Masahiro Ieda, Tokyo, all of Japan

[73] Assignee: Mitsubishi Denki Kabushiki Kaisha, Tokyo, Japan

[21] Appl. No.: 08/916,942

[22] Filed: Aug. 25, 1997

[30] Foreign Application Priority Data

Apr. 3, 1997 [JP] Japan ..... 9-085116

[51] Int. Cl.[6] ..... H05B 37/02

[52] U.S. Cl. ..... 315/307; 315/224; 315/225; 315/362

[58] Field of Search ..... 315/224, 307, 315/92, 200 A, 91, 209 R, 362, 291, 225

[56] References Cited

U.S. PATENT DOCUMENTS

| | | | |
|---|---|---|---|
| 5,111,118 | 5/1992 | Fellows et al. | 315/307 |
| 5,589,742 | 12/1996 | Ueda | 315/307 |
| 5,604,406 | 2/1997 | Gaus | 315/200 A |
| 5,604,411 | 2/1997 | Venkitasubrahmanian et al. | 315/224 |
| 5,646,484 | 7/1997 | Sharma et al. | 315/91 |
| 5,663,613 | 9/1997 | Yamashita et al. | 315/225 |
| 5,696,431 | 12/1997 | Giannopoulos et al. | 315/224 |

FOREIGN PATENT DOCUMENTS 6-243979 9/1994 Japan .

*Primary Examiner*—Don Wong
*Assistant Examiner*—Wilson Lee
*Attorney, Agent, or Firm*—Sughrue, Mion, Zinn Macpeak & Seas, PLLC

[57] ABSTRACT

A light-emission controlling apparatus including an electric discharge lamp (106) which can emit light, a unit for detecting the light-emission state of the electric discharge lamp (106), such as a light-emission time integrating unit (107) for measuring the integral of the length of time that the electric discharge lamp (106) has emitted light, a comparing unit (1082) for comparing the integral of the length of time that the electric discharge lamp (106) has emitted light which is measured by the light-emission time integrating unit (107) to a reference value, and a light-emission mode selecting unit (1083) for selecting either a first light-emission mode or a second light-emission mode according to a comparison result from the comparing unit (1082) so as to cause the electric discharge lamp (106) to emit light in one light-emission mode selected.

11 Claims, 9 Drawing Sheets

LIGHT-EMISSION CONTROLLING APPARATUS

BACKGROUND OF THE INVENTION

1. Field of the Invention

The present invention relates to a light-emission controlling apparatus disposed in an automobile or the like, for changing a light-emission mode of a light-emitting device such as an electric discharge lamp such as a high-voltage sodium lamp, or a metal halide lamp, or an incandescent lamp so that the light-emitting device switches between different light-emission modes.

2. Description of the Prior Art

Referring now to FIG. 10, there is illustrated a schematic diagram showing the structure of a prior art light-emission controlling apparatus disclosed in Japanese Patent Application Laying Open (KOKAI) No. 6-243979. In the figure, reference numeral 5 denotes an electric discharge lamp, 8 denotes a switch, 9 denotes a voltage detecting circuit having a terminal connected to a point of connection between capacitors 4*b* and 4*c* via the switch 8, for detecting a voltage across the electric discharge lamp 5 after an electric breakdown is produced in the electric discharge lamp 5, 11 denotes a current detecting circuit for detecting a current flowing through the electric discharge lamp 5, and 12 denotes an electric-breakdown detecting circuit for detecting a current which can rush into the electric discharge lamp 5 when an electric breakdown is produced in the electric discharge lamp 5 so as to generate a signal indicating whether or not an electric breakdown is produced.

Furthermore, reference numeral 13 denotes a control unit implemented via a microcomputer or the like, for switching on or off the switch 8 and for controlling the frequency of a signal delivered to an inverter circuit 2 according to signals from the voltage detecting circuit 9, the current detecting circuit 11, and the electric-breakdown detecting circuit 12, and 15 denotes an alarm lamp through which the control unit 13 can warn a user when it determines that the value of the lighting voltage across the electric discharge lamp 5, which is informed by the voltage detecting circuit 9, is not within the range of lighting voltage ratings.

In operation, when the light switch is turned on and an electric breakdown is produced in the electric discharge lamp 5, a current rushes into the electric discharge lamp 5. Then the electric-breakdown detecting circuit 12 detects the current rushing into the electric discharge lamp 5 and then furnishes a pulse indicating that an electric breakdown is produced to the control unit 13.

In response to the pulse from the electric-breakdown detecting circuit 12, the control unit 13 reads the value of the voltage across the electric discharge lamp 5 which is converted by the voltage detecting circuit 9 and compares the current value of the voltage across the electric discharge lamp with the minimum value of the lighting voltage ratings of the electric discharge lamp 5 which was preset to the control unit 13. If the control unit 13 determines that the current value of the voltage across the electric discharge lamp 5 is lower than the minimum value, it causes the alarm lamp 15 to light up.

By way of contrast, if the control unit 13 determines that the current value of the voltage across the electric discharge lamp 5 is greater than or equal to the minimum value of the lighting voltage ratings of the electric discharge lamp 5, it further compares the current value of the voltage across the electric discharge lamp to the maximum value of the lighting voltage ratings of the electric discharge lamp 5 which was preset to the control unit 13. If the control unit 13 determines that the current value of the voltage across the electric discharge lamp is greater that the maximum value, it causes the alarm lamp 15 to flash on and off.

Since the prior art light-emission controlling apparatus is constructed as mentioned above, there is a problem in that if an error arises in the detected value of the voltage across the electric discharge lamp, which shows the light-emission state of the electric discharge lamp, the light-emission controlling apparatus can immediately warn the user that the value of the voltage across the electric discharge lamp is not within the range of lighting voltage ratings.

Another problem with the prior art light-emission controlling apparatus is that since the user must consciously watch the alarm lamp disposed in addition to the electric discharge lamp, there is a possibility that the user fails to notice the warning.

SUMMARY OF THE INVENTION

The present invention is made to overcome the above-described problems. It is therefore an object of the present invention to provide a light-emission controlling apparatus capable of informing the user of the light-emission state of a light-emitting device such as an electric discharge lamp by causing the light-emitting device to emit light in a predetermined light-emission mode, without having to provide an alarm lamp or the like in addition to the light-emitting device.

In accordance with one aspect of the present invention, there is provided a light-emission controlling apparatus comprising: a light-emitting device for emitting light; a detecting unit for detecting a light-emission state of the light-emitting device; and a control unit for selecting one from at least first and second light-emission modes according to the light-emission state of the light-emitting device detected by the detecting unit, and for enabling the light-emitting device to emit light in the selected first or second light-emission mode.

Preferably, the control unit includes a comparing unit for comparing the light-emission state of the light-emitting device detected by the detecting unit to a reference light-emission state of the light-emitting device, and a light-emission mode selecting unit for selecting either the first light-emission mode or the second light-emission mode according to a comparison result from the comparing unit.

The detecting unit can detect the light-emission state of the light-emitting device by acquiring information showing how long or how many times the light-emitting device has been used. In accordance with a preferred embodiment of the present invention, the detecting unit includes a unit for measuring the integral of the length of time that the light-emitting device has emitted light since the light-emitting device was attached to the light-emission controlling apparatus, and the comparing unit compares the measured integral of the length of time that the light-emitting device has emitted light to a reference value showing the reference light-emission state of the light-emitting device. Furthermore, the light-emission mode selecting unit selects the second light-emission mode when the comparison result indicates that the measured integral of the length of time that the light-emitting device has emitted light is greater than the reference value, and the light-emission mode selecting unit selects the first light-emission mode otherwise. Preferably, the detecting unit further includes a unit for measuring or counting the number of times that the light-emitting device has emitted light since the light-emitting device was attached to the light-emission controlling apparatus, and the comparing unit further compares the measured number of times that the light-emitting device has emitted light to another reference value showing the reference light-emission state of the light-emitting device. The light-emission mode selecting unit selects the second light-emission mode when the comparison result indicates that the measured integral of the length of time that the light-emitting device has emitted light is greater than the reference value but the measured number of times that the light-emitting device has emitted light is lower than or equal to the other reference value. The light-emission mode selecting unit selects the third light-emission mode when the comparison result indicates that the measured number of times that the light-emitting device has emitted light is greater than the other reference value, and the light-emission mode selecting unit selects the first light-emission mode otherwise.

In accordance with another preferred embodiment of the present invention, the detecting unit includes a unit for counting the number of times that the light-emitting device has emitted light since the light-emitting device was attached to the light-emission controlling apparatus, and the comparing unit compares the measured number of times that the light-emitting device has emitted light to a reference value showing the reference light-emission state of the light-emitting device. Furthermore, the light-emission mode selecting unit selects the second light-emission mode when the comparison result indicates that the measured number of times that the light-emitting device has emitted light is greater than the reference value, and the light-emission mode selecting unit selects the first light-emission mode otherwise.

Preferably, when the light-emission mode selecting unit selects the first light-emission mode, the control unit enables the light-emitting device to simply light up, and when the light-emission mode selecting unit selects the second light-emission mode, the control unit enables the light-emitting device to flash on and off during a predetermined period of time. Alternatively, when the light-emission mode selecting unit selects the first light-emission mode, the control unit enables the light-emitting device to simply light up, and when the light-emission mode selecting unit selects the second light-emission mode, the control unit enables the light-emitting device to flash on and off a predetermined number of times.

In accordance with another preferred embodiment of the present invention, the detecting unit can detect the light-emission state of the light-emitting device by acquiring plural pieces of information each showing how long or how many times the light-emitting device has been used. Furthermore, the control unit can select one from among a plurality of light-emission modes according to the plural pieces of information acquired by the detecting unit, and for enabling the light-emitting device to emit light in one the light-emission mode selected.

In accordance with anther aspect of the present invention, there is provided a light-emission controlling apparatus comprising: a light-emitting device for emitting light; and a unit for determining whether or not a time to replace the light-emitting device has come so as to select a first light-emission mode when determining that a time to replace the light-emitting device has not come and select a second light-emission mode when determining that a time to replace the light-emitting device has come, and for enabling the light-emitting device to emit light in the selected first or second light-emission mode.

Preferably, the determining unit includes a unit for measuring the integral of the length of time that the light-emitting device has emitted light since the light-emitting device was attached to the light-emission controlling apparatus, a comparing unit for comparing the measured integral of the length of time that the light-emitting device has emitted light to a reference value, and a light-emission mode selecting unit for selecting either the first light-emission mode or the second light-emission mode according to a comparison result from the comparing unit.

Alternatively, the determining unit includes a unit for counting the number of times that the light-emitting device has emitted light since the light-emitting device was attached to the light-emission controlling apparatus, a comparing unit for comparing the measured number of times that the light-emitting device has emitted light to a reference value, and a light-emission mode selecting unit for selecting either the first light-emission mode or the second light-emission mode according to a comparison result from the comparing unit.

When the light-emission mode selecting unit selects the first light-emission mode, the control unit enables the light-emitting device to simply light up, and when the light-emission mode selecting unit selects the second light-emission mode, the control unit enables the light-emitting device to flash on and off during a predetermined period of time. Alternatively, when the light-emission mode selecting unit selects the first light-emission mode, the control unit enables the light-emitting device to simply light up, and when the light-emission mode selecting unit selects the second light-emission mode, the control unit enables the light-emitting device to flash on and off a predetermined number of times.

Further objects and advantages of the present invention will be apparent from the following description of the preferred embodiments of the invention as illustrated in the accompanying drawings.

DETAILED DESCRIPTION OF THE PREFERRED EMBODIMENTS

First Embodiment

Figure 1:
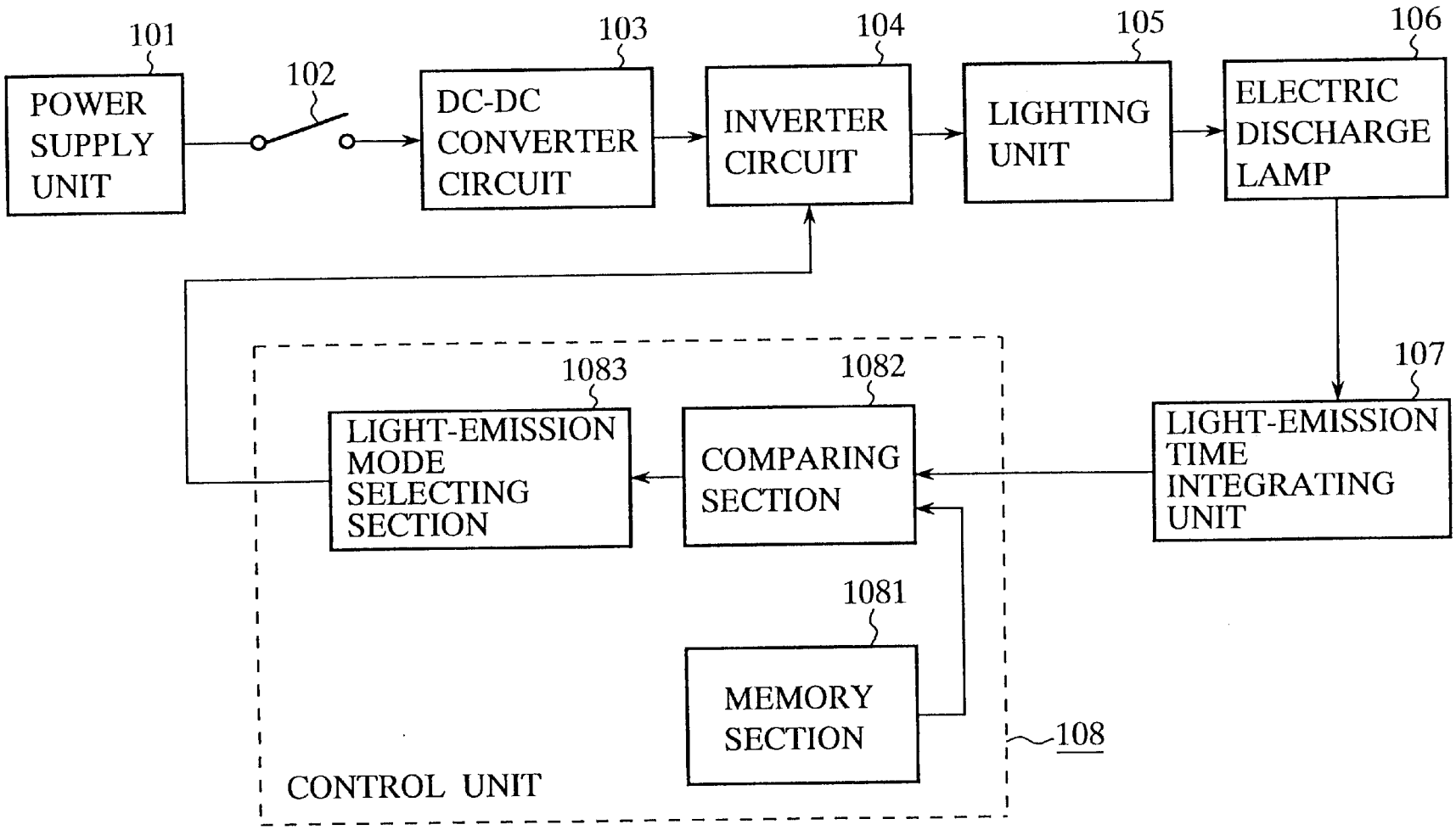
FIG. 1 is a block diagram showing the structure of a light-emission controlling apparatus according to a first embodiment of the present invention.

Referring now to FIG. 1, there is illustrated a block diagram showing the structure of a light-emission controlling apparatus according to a first embodiment of the present invention. In the figure, 101 denotes a power supply disposed within an automobile or motor vehicle, 102 denotes a switch for turning on or off the power supply 101, 103 denotes a converter circuit for DC—DC converting a voltage which is applied thereto via the switch 102 by the power supply 101, and 104 denotes an inverter circuit for amplifying a signal into which the voltage is converted by the converter circuit 103.

The inverter circuit 104 is provided with a switching element (not shown) which is turned on and off alternately, a step-up transformer (not shown) for raising the voltage of the power supply 101 converted to AC by the switching element to generate a desired voltage, and a coupling capacitor (not shown).

Reference numeral 105 denotes a lighting unit for lighting an electric discharge lamp 106, which is disposed as a light-emitting device, with the voltage furnished by the inverter circuit 104, and 107 denotes a light-emission time integrating unit which is disposed as a means for detecting the light-emission state of the electric discharge lamp 106. The light-emission time integrating unit 107 is adapted to measure the integral of the length of time that the electric discharge lamp 106 mounted in the light-emission control apparatus has emitted light since the electric discharge lamp 106 was attached to the light-emission controlling apparatus of this embodiment.

Furthermore, reference numeral 108 denotes a control unit provided with a memory section 1081 for prestoring a reference value (e.g., one thousand hours) of the integral of the length of time that the electric discharge lamp 106 has emitted light since it was attached to the light-emission controlling apparatus, a comparing section 1082 for comparing the integral of the length of time showing the light-emission state of the electric discharge lamp 106, which is measured by the light-emission time integrating unit 107, to the reference value stored in the memory section 1081, and a light-emission mode selecting section 1083 for selecting either a first light-emission mode wherein the electric discharge lamp 106 emits light normally (i.e., simply lights up) or a second light-emission mode wherein, for example, the electric discharge lamp 106 flashes on and off during a predetermined period of time, according to the comparison result obtained by the comparing section 1082, to furnish a selecting signal to the inverter circuit 104, so that the inverter circuit 104 enables the lighting unit 105 to light the electric discharge lamp 106. The light-emission mode selecting section 1083 selects the second light-emission mode when the integral of the length of light-emission time measured by the light-emission time integrating unit 107 exceeds the reference value stored in the memory section 1081. In this specification, the reference value is referred to as the reference light-emission integrated time. Similarly, the integral of the length of time that the electric discharge lamp has emitted light since it was attached to the light-emission controlling apparatus is referred to as the light-emission integrated time.

The inverter circuit 104 thus enables the lighting unit 105 to cause the electric discharge lamp 106 to emit light in either the first or second light-emission mode according to the selecting signal furnished by the light-emission mode selecting section 1083.

Figure 2:
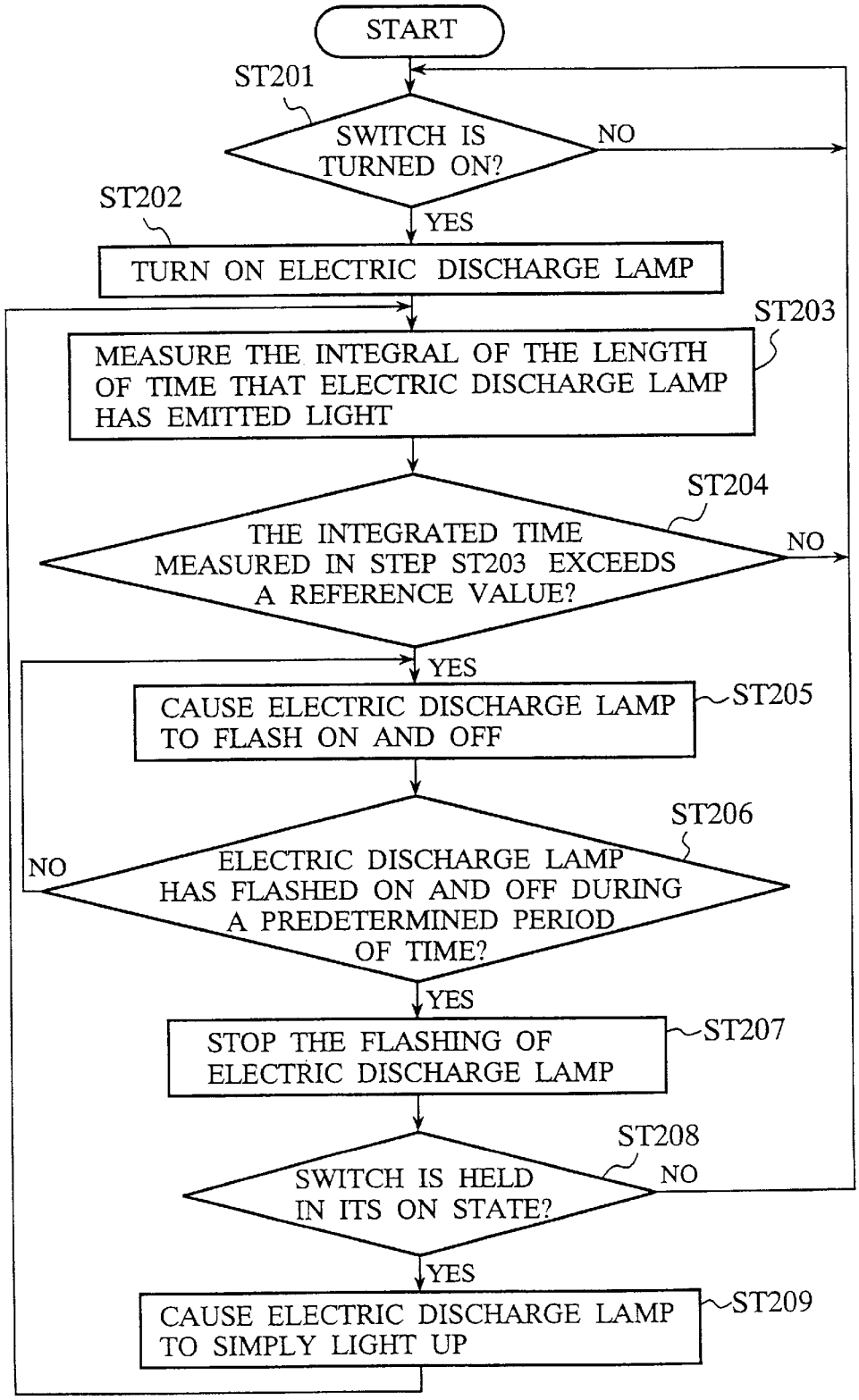
FIG. 2 is a flow diagram showing the operation of the light-emission controlling apparatus shown in FIG. 1.

Referring next to FIG. 2, there is illustrated a flow diagram showing the operation of the light-emission controlling apparatus shown in FIG. 1. Next, a description will be made as to the operation of the light-emission controlling apparatus according to the first embodiment of the present invention with reference to FIG. 2. When the user, for example, switches on a switch (not shown), the light-emission controlling apparatus is initiated and the switch 102 is closed, so that the DC-DC converter circuit 103 is coupled to the power supply 101. The DC—DC converter 103 then in step ST201 determines whether or not the switch 102 is turned on. The DC—DC converter 103 can make the determination by detecting a current flowing from the power supply 101 into the DC—DC converter.

When the DC—DC converter 103 in step ST201 determines that the switch 102 is turned on, the DC—DC converter 103, in step ST202, enables the inverter circuit 104 to allow the lighting unit 105 to light the electric discharge lamp 106 in the first light-emission mode. On the other hand, when it is determined that the switch 102 is held in its off state in step ST201, the control unit 108 repeats step ST201.

After performing step ST202, the light-emission time integrating unit 107, in step ST203, measures the integral of the length of time that the electric discharge lamp 106 has emitted light since it was attached to the light-emission controlling apparatus. The comparing section 1082 then in step ST204 compares the measured integral of the length of light-emission time to the reference light-emission integrated time stored in the storing section 1081.

Figure 3:
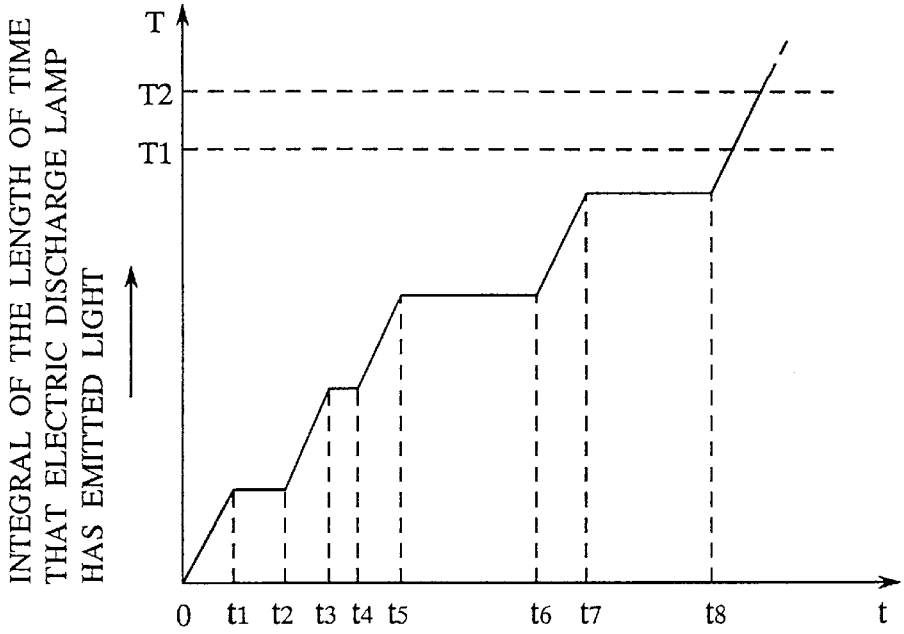
FIG. 3 is a diagram showing a relationship between the time that has elapsed since an electric discharge lamp was attached to the light-emission controlling apparatus and the integral of the length of time that the electric discharge lamp has emitted light since it was attached to the light-emission controlling apparatus.

Next, a description will be made as to the comparing process performed in step ST204 with reference to FIG. 3. FIG. 3 shows a relationship between the time that has elapsed since the electric discharge lamp 106 was attached to the light-emission controlling apparatus and the integral of the length of time that the electric discharge lamp 106 has emitted light since it was attached to the light-emission controlling apparatus. In FIG. 3, the horizontal axis shows the time that has elapsed since the electric discharge lamp 106 was attached to the light-emission controlling apparatus, and the vertical axis shows the integral of the length of time that the electric discharge lamp 106 has emitted light since it was attached to the light-emission controlling apparatus. Furthermore, T1 shows the reference light-emission integrated time, and T2 shows a limit of the integral of the length of time that the electric discharge lamp 106 can continue to emit light, and, in general, shows the time to replace the electric discharge lamp 106, that is, it means the lifetime of the electric discharge lamp 106.

In FIG. 3, a plurality of horizontal parts (t1→t2, t3→t4, t5→t6, t7→t8) each indicates that during each of the corresponding periods of time, the switch 102 is held in its off state and hence the light-emission integrated time is not varied, and a plurality of other parts (0→t1, t2→t3, t4→t5, t6→t7, t8→current time) each indicates that during each of the corresponding periods of time, the switch 102 is held in its on state and hence the light-emission integrated time is increased.

The comparing section 1082 compares the reference light-emission integrated time T1 (e.g., one thousand hours) to the current light-emission integrated time (e.g., four hundred hours at t4) measured by the light-emission time integrating unit 107 so as to determine whether or not the measured light-emission integrated time exceeds the reference light-emission integrated time T1. When it is determined, in step ST204, that the measured light-emission integrated time exceeds the reference light-emission integrated time T1, but is lower than the limit T2 of the light-emission integrated time, the light-emission mode selecting section 1083 furnishes a selecting signal for selecting the second light-emission mode to enable the inverter circuit 104 to cause the electric discharge lamp 106 to flash on and off during a predetermined period of time, i.e., a predetermined number of times. The inverter circuit 104 then in step ST205 causes the electric discharge lamp 106 to flash on and off during the predetermined period of time according to the selecting signal from the light-emission mode selecting section 1083 through the lighting unit. On the other hand, when it is determined, in step ST204, that the measured light-emission integrated time does not exceed the reference light-emission integrated time T1, the control unit 108 returns to step ST201 and repeats the above processing.

Figure 4A:
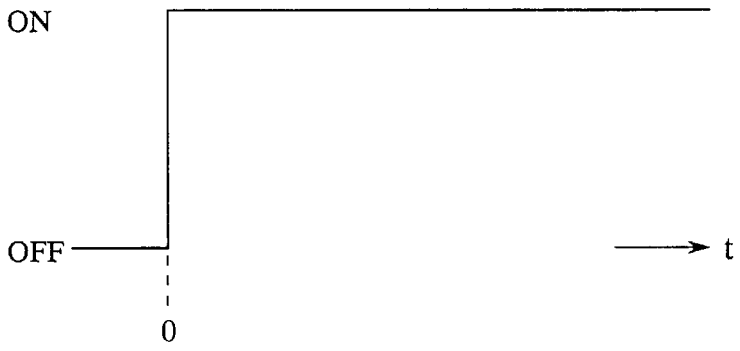
FIG. 4*a* is a diagram showing the waveform of a control signal applied to a lighting unit to cause the electric discharge lamp to simply light up when a first light-emission mode is selected.
Figure 4B:
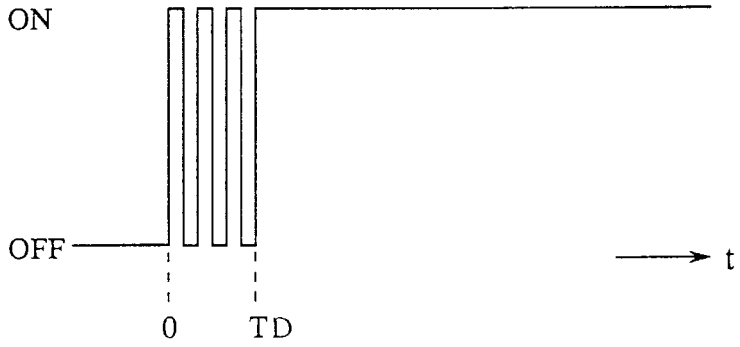
FIG. 4*b* is a diagram showing the waveform of a control signal applied to the lighting unit to cause the electric discharge lamp to flash on and off when a second light-emission mode is selected.

Next, a description will be made as to how the inverter circuit 104 causes the electric discharge lamp 106 to simply light up or flash on and off in performing step ST205 with reference to FIGS. 4*a* and 4*b*. FIG. 4*a* is a diagram showing the waveform of a control signal applied to the lighting unit for causing the electric discharge lamp 106 to simply light up when the first light-emission mode is selected, and FIG. 4*b* is a diagram showing the waveform of a control signal applied to the lighting unit for causing the electric discharge lamp 106 to flash on and off when the second light-emission mode is selected. As shown in FIG. 4*a,* in the first light-emission mode, the inverter circuit 104 generates a control signal to enable the electric discharge lamp 106 to perform only one switching operation from its off state to its on state and hence simply light up. As shown in FIG. 4*b,* in the second light-emission mode, the inverter circuit 104 generates a control signal to enable the electric discharge lamp 106 to perform the switching between its on and off states only a predetermined number of times (e.g., three times) and hence flash on and off the predetermined number of times until a predetermined period of time TD elapses since the light-emission mode selecting unit 1083 selected the second light-emission mode.

The lighting unit 105 then in step ST206 determines whether or not the inverter circuit 104 has performed the switching between its on and off states the predetermined number of times so as to cause the electric discharge lamp 106 to flash on and off during the predetermined period of time TD (e.g., thirty seconds). As previously mentioned, during the predetermined time period TD the electric discharge lamp 106 flashes on and off only the predetermined number of times, e.g., only the three times. When it is determined, in step ST206, that the predetermined time TD has elapsed since the electric discharge lamp 106 started to flash on and off, the inverter circuit 104 causes the electric discharge lamp 106 to stop flashing in step ST207. The DC—DC converter 103 then in step ST208 determines whether the switch 102 is held in its on state or the switch 102 has been switched to its off state. On the other hand, when it is determined, in step ST206, that the predetermined time TD has not elapsed since the electric discharge lamp 106 started to flash on and off, the control unit 108 returns to step ST205.

When it is determined, in step ST208, that the switch 102 is held in its on state, the inverter circuit 104 causes the electric discharge lap 106 to simply light up in step ST209. After performing step ST209, the control unit 108 returns to step ST203 and repeats the above processing. On the other hand, when it is determined, in step ST208, that the switch 102 has been already switched to its off state, the control unit 108 returns to step ST201 and repeats the above processing.

Accordingly, the light-emission control apparatus according to the first embodiment of the present invention makes it possible to, when the measured light-emission integrated time of the electric discharge lamp 106 exceeds the reference light-emission integrated time T1, cause the electric discharge lamp 106 to flash on and off during the predetermined period of time so as to inform the user that the time to replace the electric discharge lamp 106 has come, before the measured light-emission integrated time reaches the limit T2 of the light-emission integrated time, in which case the light-emission state of the electric discharge lamp 106 can be easily made unstable. Therefore, the user can easily realize that the time to replace the electric discharge lamp 106 has come.

Second Embodiment

Figure 5:
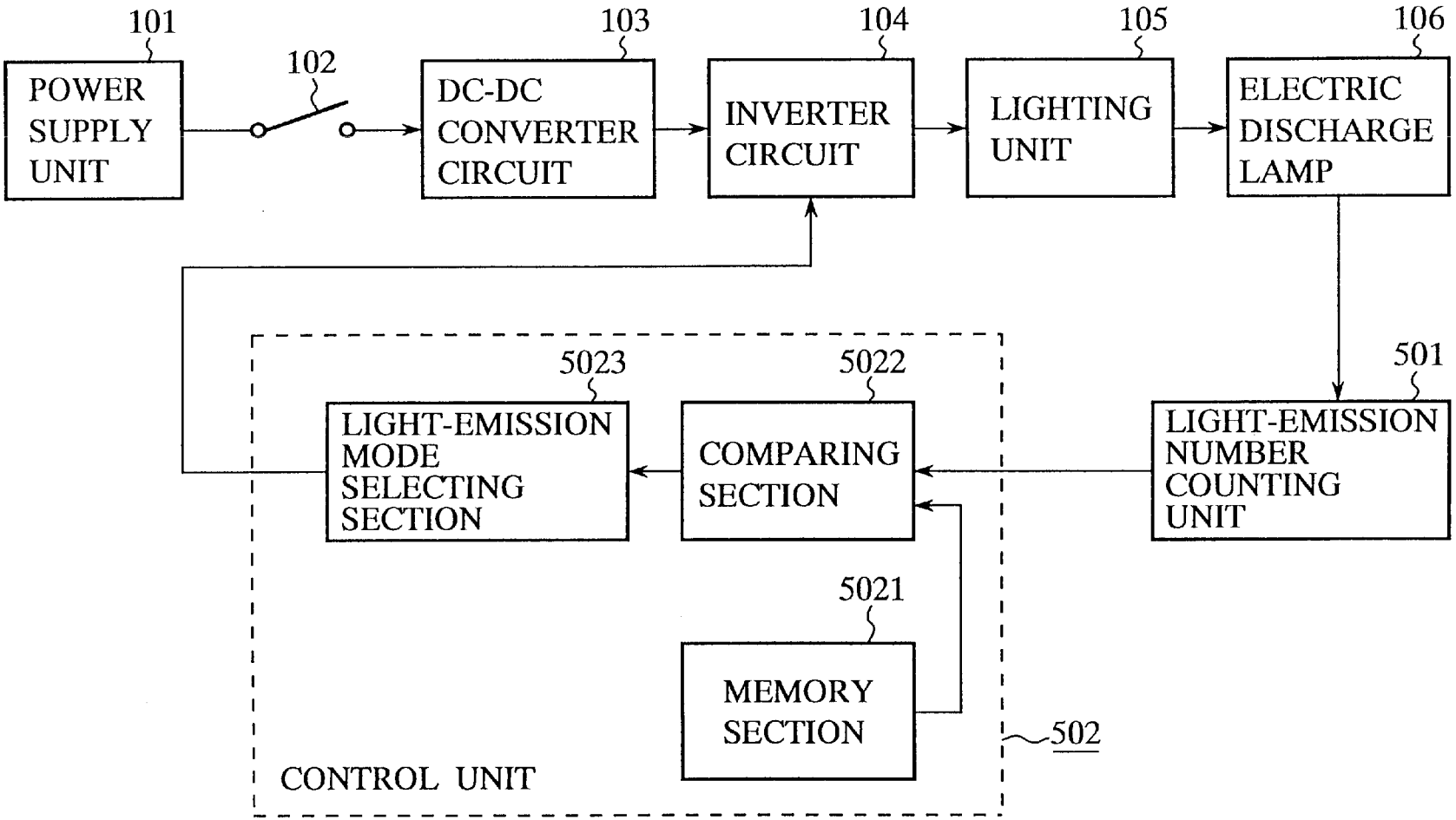
FIG. 5 is a block diagram showing the structure of a light-emission controlling apparatus according to a second embodiment of the present invention.

Referring now to FIG. 5, there is illustrated a block diagram showing the structure of a light-emission controlling apparatus according to a second embodiment of the present invention. In the figure, the same components as the light-emission controlling apparatus of the above-mentioned first embodiment or like components are designated by the same reference numerals as those in FIG. 1, and therefore the description about the components will be omitted hereinafter.

In FIG. 5, reference numeral 501 denotes a light-emission number counting unit for counting the number of times that the electric discharge lamp 106 has emitted light since the electric discharge lamp was attached to the light-emission controlling apparatus, which is disposed as a means for detecting the light-emission state of the electric discharge lamp 106. The light-emission number counting unit 501 is adapted to measure the number of times that the electric discharge lamp 106 mounted in the light-emission control apparatus has emitted light since it was attached to the light-emission controlling apparatus, for example, the number of times that the electric discharge lamp 106 has been turned on since it was attached to the light-emission controlling apparatus.

Furthermore, reference numeral 502 denotes a control unit provided with a memory section 5021 for prestoring a reference value (e.g., one thousand times) of the number of times that the electric discharge lamp 106 has emitted light since it was attached to the light-emission control apparatus, a comparing section 5022 for comparing the number of times that the electric discharge lamp 106 has emitted light since the electric discharge lamp was attached to the light-emission controlling apparatus, which shows the current light-emission state of the electric discharge lamp 106, and which is measured by the light-emission number counting unit 501, to the reference value stored in the memory section 5021, and an light-emission mode selecting section 5023 for selecting either a first light-emission mode wherein the electric discharge lamp 106 emits light normally (i.e., simply lights up) or a second light-emission mode wherein, for example, the electric discharge lamp 106 flashes on and off during a predetermined period of time, according to the comparison result obtained by the comparing section 5022, to furnish a selecting signal to the inverter circuit 104, so that the inverter circuit 104 enables the lighting unit 105 to light the electric discharge lamp 106. The light-emission mode selecting section 5023 selects the second light-emission mode when the number of times that the electric discharge lamp 106 has emitted light since the electric discharge lamp was attached to the light-emission controlling apparatus, which is measured by the light-emission number counting unit 501, exceeds the reference value stored in the memory section 5021. In this specification, the reference value is referred to as the reference light-emission number of times. Similarly, the number of times that the electric discharge lamp 106 has emitted light since it was attached to the light-emission controlling apparatus is referred to as the light-emission number of times.

The inverter circuit 104 thus enables the lighting unit 105 to cause the electric discharge lamp 106 to emit light in either the first or second light-emission mode according to the selecting signal furnished by the light-emission mode selecting section 5023.

Figure 6:
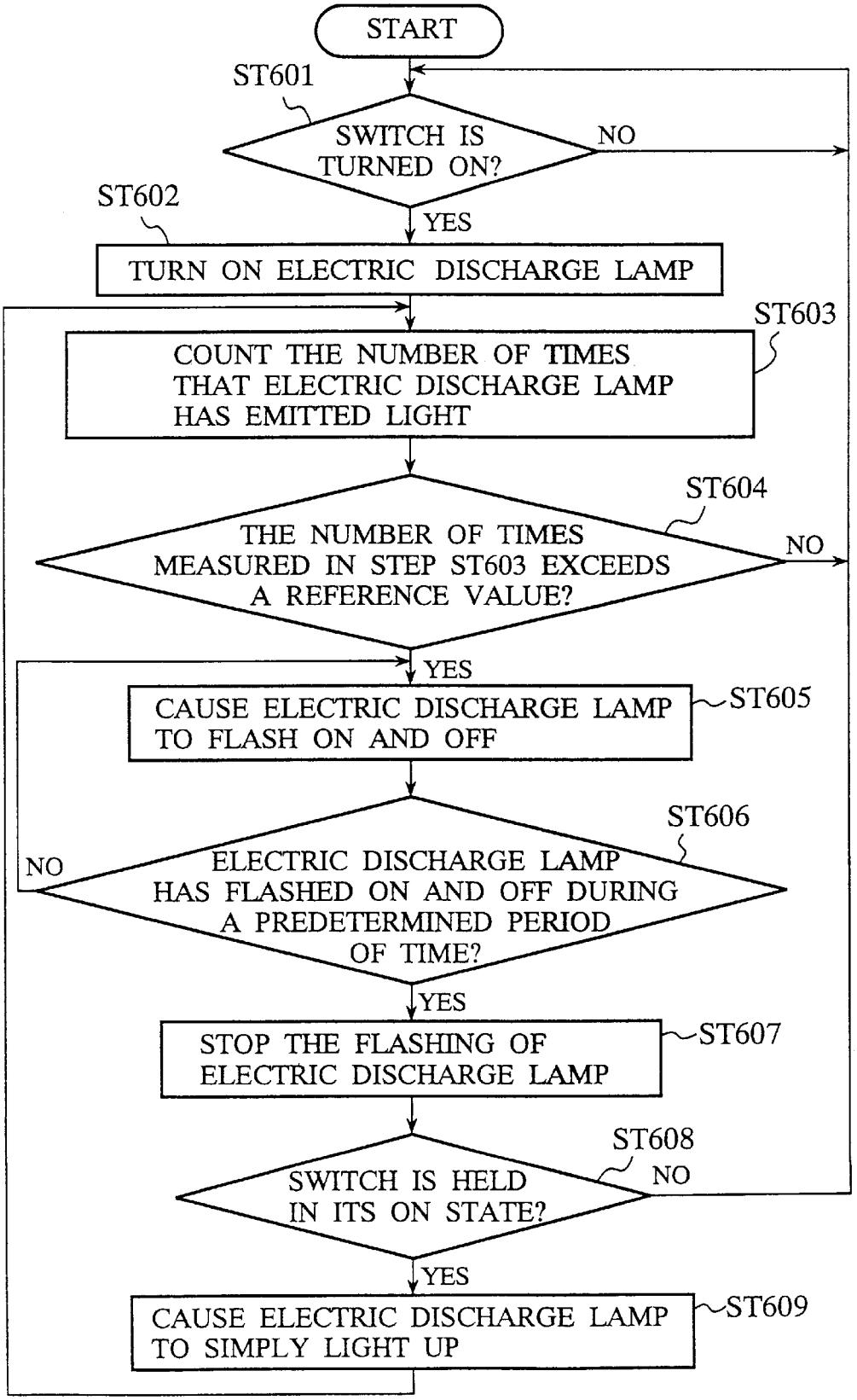
FIG. 6 is a flow diagram showing the operation of the light-emission controlling apparatus shown in FIG. 5.

Referring next to FIG. 6, there is illustrated a flow diagram showing the operation of the light-emission controlling apparatus shown in FIG. 5. Next, a description will be made as to the operation of the light-emission controlling apparatus according to the second embodiment of the present invention with reference to FIG. 6. When the user, for example, switches on a switch (not shown), the light-emission controlling apparatus is initiated and the switch 102 is closed, so that the DC—DC converter circuit 103 is coupled to the power supply 101. Then the control unit 502 advances to steps ST601 and ST602. The processes performed in steps ST601 to ST602 are the same as those performed in steps ST201 to ST202 of the first embodiment mentioned above, and therefore the description about the processes will be omitted hereinafter.

After the inverter circuit 104 enables the electric discharge lamp 106 to emit light in performing step ST602, the light-emission number counting unit 501, in step ST603, counts the number of times that the electric discharge lamp 106 has emitted light since it was attached to the light-emission controlling apparatus. The comparing section 5022 then in step ST604 compares the measured number of times that the electric discharge lamp 106 has emitted light to the reference light-emission number of times stored in the storing section 5021.

Figure 7:
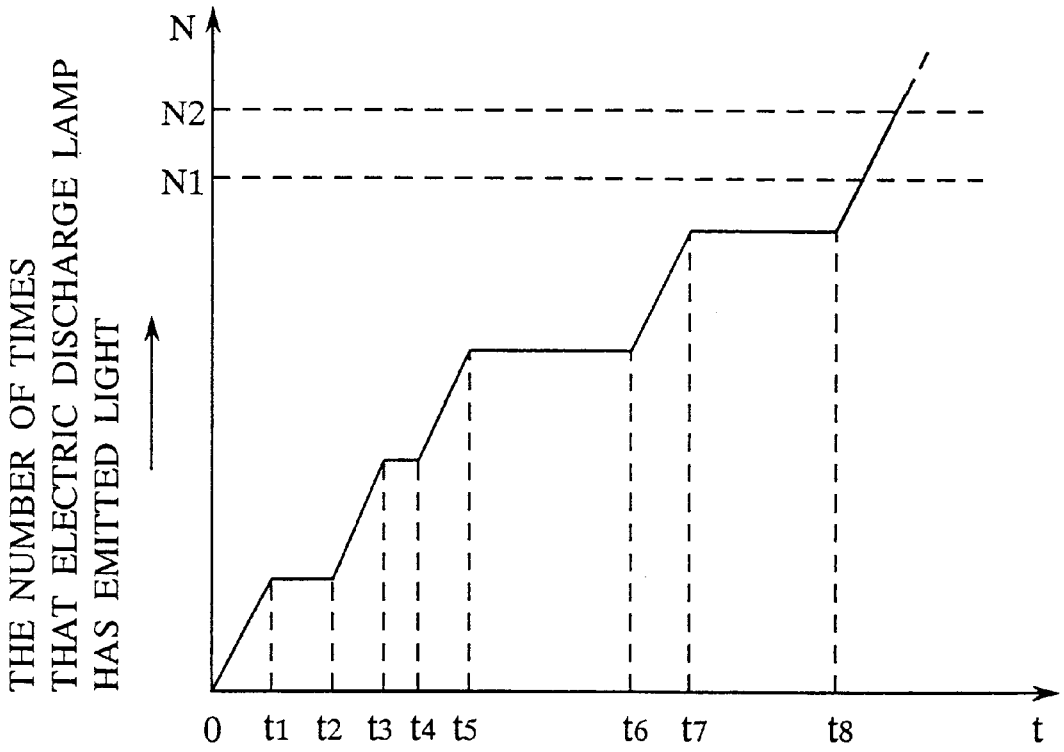
FIG. 7 is a graph showing a relationship between the time that has elapsed since an electric discharge lamp was attached to the light-emission controlling apparatus shown in FIG. 5 and the number of times that the electric discharge lamp has emitted light since it was attached to the light-emission controlling apparatus.

Next, a description will be made as to the comparing process performed in step ST604 with reference to FIG. 7. FIG. 7 shows a relationship between the time that has elapsed since the electric discharge lamp 106 was attached to the light-emission controlling apparatus and the number of times that the electric discharge lamp 106 has emitted light since it was attached to the light-emission controlling apparatus. In FIG. 7, the horizontal axis shows the time that has elapsed since the electric discharge lamp 106 was attached to the light-emission control apparatus, and the vertical axis shows the number of times that the electric discharge lamp 106 has emitted light since it was attached to the light-emission control apparatus. Furthermore, N1 shows the reference light-emission number of times, and N2 shows a limit of the number of times that the electric discharge lamp 106 can emit light. In general, the limit N2 shows the time to replace the electric discharge lamp 106, that is, it means the lifetime of the electric discharge lamp 106.

In FIG. 7, horizontal parts (t1→t2, t3→t4, t5→t6, t7→t8) each indicates that during each of the corresponding periods of time, the switch 102 is held in its off state and hence the number of times that the electric discharge lamp 106 has emitted light is not varied, and other parts (0→t1, t2→t3, t4→t5, t6→t7, t8→current time) each indicates that during each of the corresponding periods of time, the switch 102 is turned on a number of times and hence the number of times that the electric discharge lamp 106 has emitted light is increased.

The comparing section 5022 compares the reference light-emission number of times N1 (e.g., one thousand times) to the current light-emission number of times (e.g., four hundred times at t4) measured by the light-emission number counting unit 501 so as to determine whether or not the measured light-emission number of times exceeds the reference light-emission number of times N1. When it is determined, in step ST604, that the measured light-emission number of times exceeds the reference light-emission number of times N1, but is lower than the limit N2 of the light-emission number of times, the light-light-emission mode selecting section 5023 furnishes a selecting signal for selecting the second light-emission mode to enable the inverter circuit 104 to cause the electric discharge lamp 106 to flash on and off during a predetermined period of time, i.e., only a predetermined number of times. The inverter circuit 104 then in step ST605 causes the electric discharge lamp 106 to flash on and off during the predetermined period of time according to the selecting signal from the light-light-emission mode selecting section 5023 through the lighting unit. On the other hand, when it is determined, in step ST604, that the measured light-emission number of times does not exceed the reference light-emission number of times N1, the control unit 501 returns to step ST601 and repeats the above processing.

After performing step ST605, the control unit 501 advances to steps ST606 to ST609. The processes in the steps ST606 to ST609 are performed similarly to the processes in steps ST206 to ST209 of the first embodiment mentioned above, and therefore the description about the processes in the steps ST606 to ST609 will be omitted hereinafter.

Accordingly, the light-emission controlling apparatus according to the second embodiment of the present invention makes it possible to, when the measured light-emission number of times that the electric discharge lamp 106 has emitted light exceeds the reference light-emission number of times N1, cause the electric discharge lamp 106 to flash on and off during the predetermined time period so as to inform the user that the time to replace the electric discharge lamp 106 has come, before the measured light-emission number of times reaches the limit N2, in which case the light-emission state of the electric discharge lamp 106 can be easily made unstable. Therefore, the user can easily realize that the time to replace the electric discharge lamp 106 has come.

Third Embodiment

A light-emission controlling apparatus according to a third embodiment of the present invention comprises the same light-emission time integrating unit 107 as the above-mentioned first embodiment and the same light-emission number counting unit 501 as the above-mentioned second embodiment. The light-emission controlling apparatus is adapted to select one from among a plurality of light-emission modes by respectively comparing the measured integral of the length of time and the measured number of times that the electric discharge lamp 106 has emitted light since it was attached to the light-emission controlling apparatus to their reference values, and then cause the electric discharge lamp 106 to emit light in the selected light-emission mode.

Figure 8:
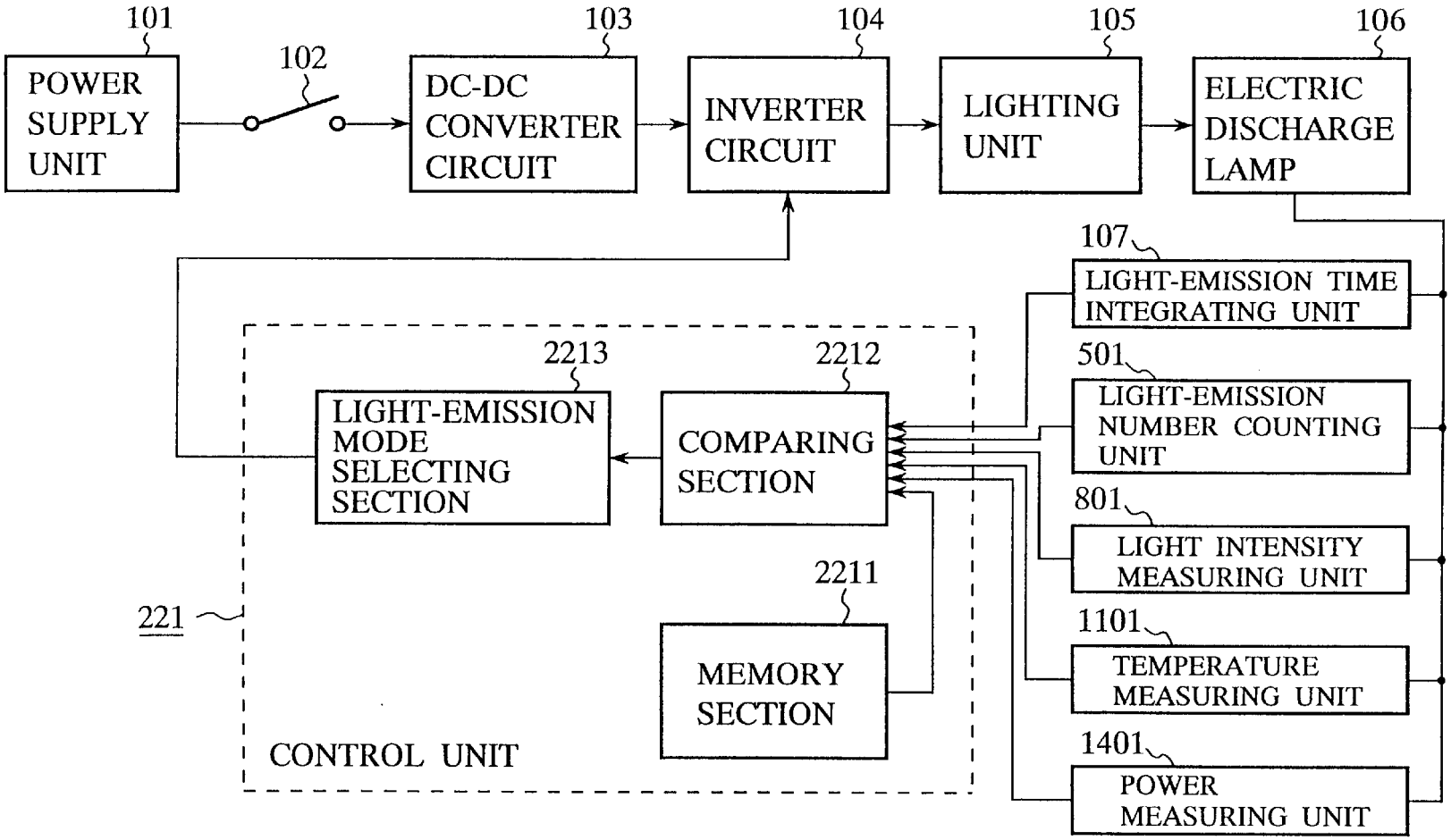
FIG. 8 is a block diagram showing the structure of a light-emission controlling apparatus according to a third embodiment of the present invention.

Referring next to FIG. 8, there is illustrated a block diagram showing the structure of a light-emission controlling apparatus according to the third embodiment of the present invention. In the figure, the same components as the light-emission controlling apparatuses of the above-mentioned first and second embodiments or like components are designated by the same reference numerals as those in FIGS. 1 and 5, and therefore the description about the components will be omitted hereinafter.

In FIG. 8, reference numeral 801 denotes a light intensity measuring unit for measuring the instantaneous value of the intensity of light emitted out of the electric discharge lamp 106, 1101 denotes a temperature measuring unit for measuring the ambient temperature in the vicinity of the electric discharge lamp 106, and 1401 denotes a power measuring unit for measuring power supplied to the electric discharge lamp 106.

Furthermore, reference numeral 221 denotes a control unit provided with a memory section 2211 for prestoring a plurality of reference values, each showing the current light-emission state of the electric discharge lamp 106, of the integral of the length of time that the electric discharge lamp 106 has emitted light since it was attached to the light-emission control apparatus, the number of times that the electric discharge lamp 106 has emitted light since it was attached to the light-emission control apparatus, the light intensity of the electric discharge lamp 106, the ambient temperature, and the power supplied to the electric discharge lamp 106, a comparing section 2212 for respectively comparing the measurement results by the light-emission time integrating unit 107, the light-emission number counting unit 501, the light intensity measuring unit 801, the temperature measuring unit 1101, and the power measuring unit 1401, to the plurality of reference values stored in the memory section 2211, and a light-emission mode selecting section 2213 for selecting one from among a plurality of light-emission modes according to the comparison results obtained by the comparing section 2212, to furnish a selecting signal to the inverter circuit 104 so as to light the electric discharge lamp 106 in the selected light-emission mode.

The inverter circuit 104 thus enables the lighting unit 105 to cause the electric discharge lamp 106 to emit light in one light-emission mode selected according to the selecting signal furnished by the light-emission mode selecting section 2213.

When the user, for example, switches on a switch (not shown), the switch 102 is closed and therefore the DC—DC converter circuit 103 is coupled to the power supply unit 101. After that, the light-emission time integrating unit 107 measures the integral of the length of time that the electric discharge lamp 106 has emitted since it was attached to the light-emission controlling apparatus, like the above-mentioned first embodiment. In addition, the light-emission number counting unit 501 measures the number of times that the electric discharge lamp 106 has emitted since it was attached to the light-emission controlling apparatus, like the above-mentioned second embodiment. Then the comparing section 2212 compares the measured integral of the length of light-emission time and the measured number of light-emission times to the corresponding reference values, respectively, and furnishes comparison results to the light-emission mode selecting section 2213.

If the comparison results indicate that both the measured integral of the length of light-emission time and the measured number of light-emission times do not exceed the reference light-emission integrated time and reference light-emission number of times, respectively, the light-emission mode selecting section 2213 selects the first light-emission mode and furnishes a selecting signal to cause the electric discharge lamp 106 to simply light up to the inverter circuit 104. By way of contrast, when another light-emission mode is selected, the electric discharge lamp 106 is caused to flash on and off a predetermined number of times. That is, if the comparison results indicate that the measured integral of the length of light-emission time exceeds the reference light-emission integrated time but the measured light-emission number of times does not exceed the reference light-emission number of times, the light-emission mode selecting section 2213 selects the second light-emission mode and furnishes a selecting signal to cause the electric discharge lamp 106 to flash on and off a predetermined number of times, e.g., three times, to the inverter circuit 104. If the comparison results indicate that both the measured integral of the length of light-emission time and the measured light-emission number of times exceed the reference light-emission integrated time and reference light-emission number of times, respectively, the light-emission mode selecting section 2213 selects the third light-emission mode and furnishes a selecting signal to cause the electric discharge lamp 106 to flash on and off another predetermined number of times, e.g., five times, to the inverter circuit 104.

The light intensity of the electric discharge lamp 106 is decreased with use. The ambient temperature in the vicinity of the electric discharge lamp 106 is increased with use. Similarly, the power supplied to the electric discharge lamp 106 is increased with use. Furthermore, when the electric discharge lamp 106 is out of order, the light intensity, the ambient temperature, and the power can be varied. Therefore, by prestoring values of the light intensity, the ambient temperature, and the power when the time to replace the electric discharge lamp 106 has come, as their reference values, in the memory section 2211, the comparing section 2212 can compare the measured current light-intensity of the electric discharge lamp 106, the measured ambient temperature in the vicinity of the electric discharge lamp 106, and the measured power supplied to the electric discharge lamp 106 to the reference values, respectively. The light-emission mode selecting section 2213 can select a fourth, fifth, or sixth light-emission mode according to comparison results from the comparing section 2212.

Accordingly, since the light-emission controlling apparatus according to the third embodiment can select one light-emission mode according to which one of the integral of the length of time that the electric discharge lamp 106 has emitted light since it was attached to the light-emission controlling apparatus, the number of times that the electric discharge lamp 106 has emitted light since it was attached to the light-emission controlling apparatus, the light intensity of the electric discharge lamp 106, and so on, exceeds the corresponding reference value, and cause the electric discharge lamp 106 to emit light in the selected light-emission mode to generate a warning, the user can easily determine which one of the plural pieces of information such as the integrated light-emission time, the light-emission number of times, the light intensity, and so on, each of which shows the light-emission state of the electric discharge lamp 106, caused the generation of the warning, on the basis of, for example, a number of times that the electric discharge lamp 106 had flashed on and off. Therefore, the user can easily realize that the time to replace the electric discharge lamp 106 has come or that there is something wrong with the electric discharge lamp 106.

Fourth Embodiment

Figure 9:
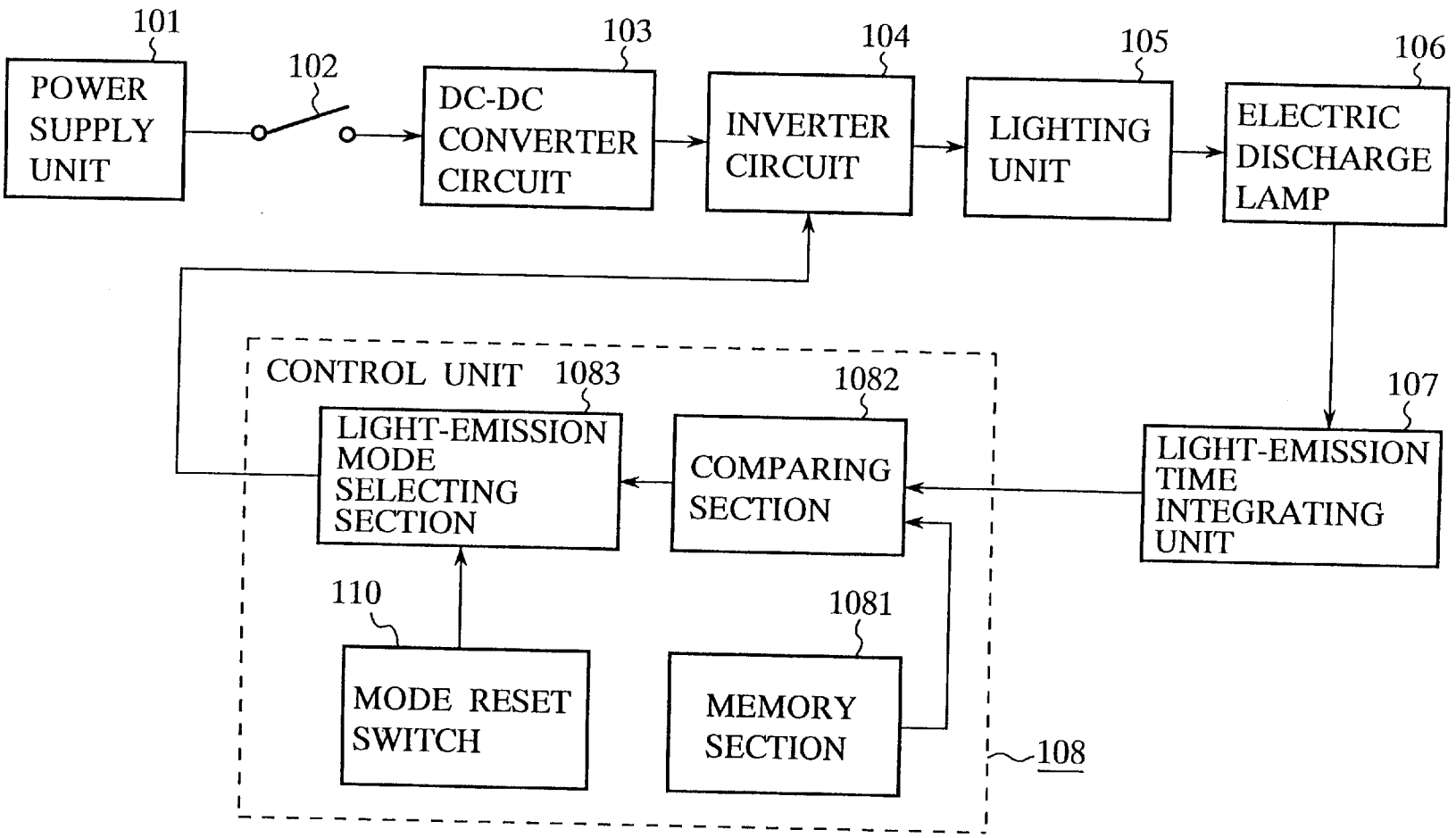
FIG. 9 is a block diagram showing the structure of a light-emission controlling apparatus according to a fourth embodiment of the present invention.
Figure 10:
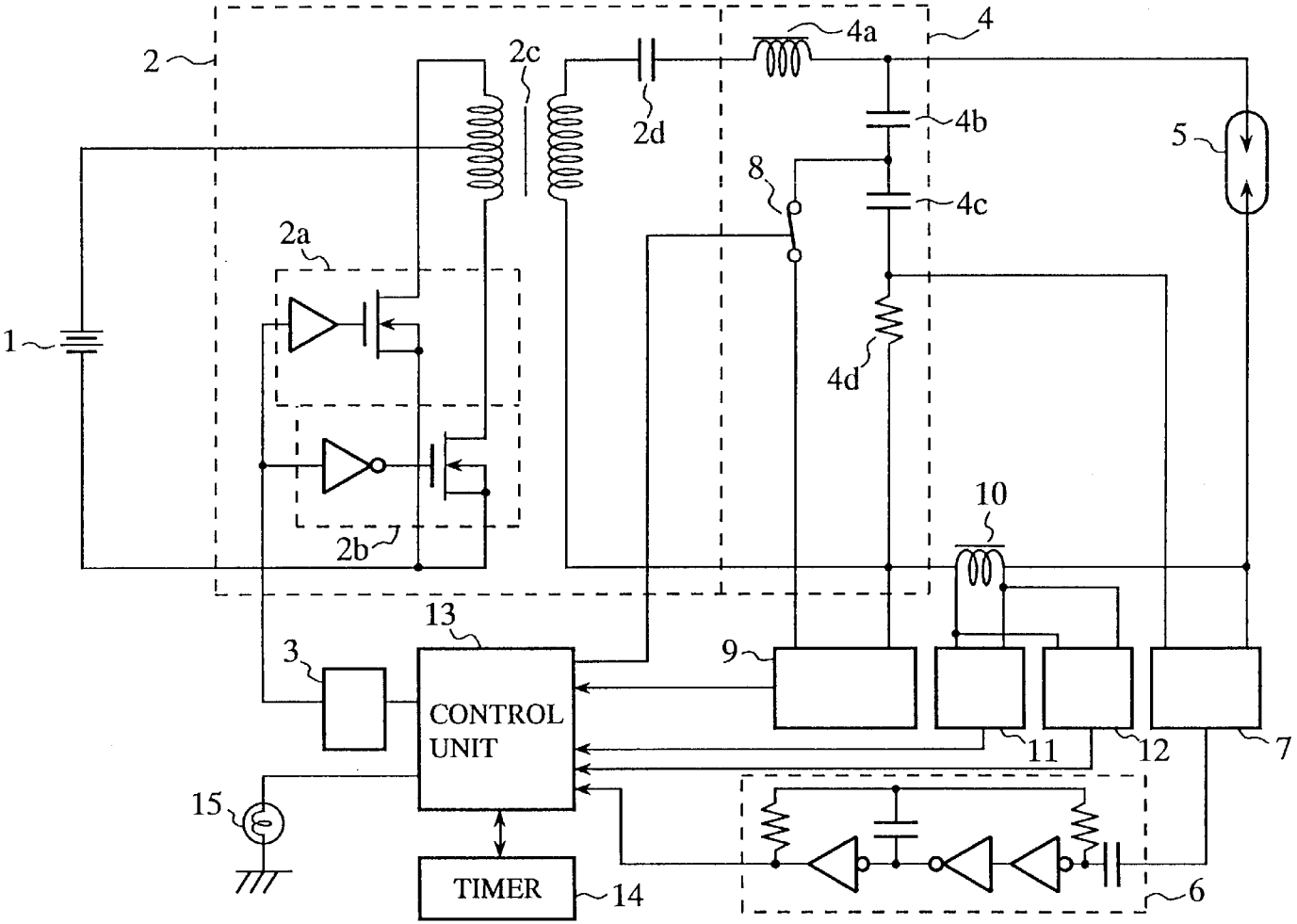
FIG.10(PRIOR ART)
FIG. 10 is a schematic diagram showing the structure of a prior art light-emission controlling apparatus.

Referring next to FIG. 9, there is illustrated a block diagram showing the structure of a light-emission controlling apparatus according to a fourth embodiment of the present invention. In the figure, the same components as the light-emission controlling apparatus of the above-mentioned first embodiment or like components are designated by the same reference numerals as those in FIG. 1, and therefore the description about the components will be omitted hereinafter. In FIG. 9, reference numeral 110 denotes a mode reset switch, which is enabled by a user's operation, for causing the electric discharge lamp 106 which is flashing on and off in the second light-emission mode to change to the first light-emission mode in which the electric discharge lamp 106 simply lights up.

Since the basic operation of the light-emission controlling apparatus of this embodiment is the same as that of the light-emission controlling apparatus of the above-mentioned first embodiment, a description will be made as to only a difference between the fourth and first embodiments. When the light-emission mode selecting section 1083 selects the second light-emission mode, the inverter circuit 104 causes the electric discharge lamp 106 to flash on and off only a predetermined number of times through the lighting unit 105 in response to the selecting signal from the light-emission mode selecting section 1083. At that time, if the user realizes that the electric discharge lamp 106 is emitting light in the second light-emission mode and then actuates the mode reset switch 110, the light-emission mode selecting section 1083 furnishes a selecting signal to select the first light-emission mode to the inverter circuit 104 before the electric discharge lamp 106 finishes flashing on and off a predetermined number of times. As a result, the electric discharge lamp 106 switches from the second light-emission mode to the first light-emission mode in which the electric discharge lamp 106 simply lights up.

Accordingly, since the light-emission controlling apparatus according to the fourth embodiment of the present invention can switch the electric discharge lamp 106 from the second light-emission mode to the first light-emission mode in which the electric discharge lamp 106 simply lights up when the user actuates the mode reset switch 110, the light-emission controlling apparatus can afford more convenience to the user. It is needless to say that the light-emission controlling apparatus according to any one of the above-mentioned second and third embodiments can comprise the mode reset switch 110 of the this embodiment.

Numerous variants may be made in the exemplary embodiments. It is clear in particular that instead of causing the electric discharge lamp 106 to flash on and off a predetermined number of times so as to inform the user that, for example, the measured integral of the length of time that the electric discharge lamp 106 has emitted light when the light-emission mode selecting section selects the second light-emission mode, any method of warning the user by controlling the light-emission state of the electric discharge lamp 106 other than causing the electric discharge lamp 106 to simply light up may suffice. For example, it is preferable to hold the electric discharge lamp 106 in its off state during a predetermined period of time after the switch 102 is turned on. Thus the user can easily realize that, for example, the time to replace the electric discharge lamp 106 has come.

It is also apparent that instead of furnishing a selecting signal to the inverter circuit 104 when the light-emission mode selecting section selects one light-emission mode of the electric discharge lamp 106, the light-emission mode selecting section could furnish a control signal which corresponds to the selected light-emission mode to the switch 102 so as to cause the electric discharge lamp 106 to emit light in the selected light-emission mode. The variant so constructed can offer the same advantage as the above first to fifth embodiments.

As previously explained, the present invention offers the following advantages.

In accordance with a preferred embodiment of the present invention, there is provided a light-emission controlling apparatus comprising a light-emitting device for emitting light such as an electric discharge device, a detecting unit for detecting a light-emission state of the light-emitting device, a comparing unit for comparing the light-emission state of the light-emitting device detected by the detecting unit to a reference light-emission state of the light-emitting device, and a light-emission mode selecting unit for selecting either a first light-emission mode wherein the light-emitting device simply lights up or a second light-emission mode wherein the light-emitting device flashes on and off during a predetermined time period according to a comparison result from the comparing unit so as to cause the light-emitting device to emit light in the selected light-emission mode. Accordingly, the light-emission control apparatus according to this embodiment of the present invention makes it possible to cause the light-emitting device to flash on and off during the predetermined period of time by detecting the light-emission state of the light-emitting device so as to inform the user that, for example, the time to replace the light-emitting device has come. Therefore, the user can easily realize that the time to replace the light-emitting device has come. The improvement of this embodiment thus increases the reliability of the light-emission controlling apparatus.

In accordance with another preferred embodiment of the present invention, the detecting unit detects the light-emission state of the light-emitting device by measuring the integral of the length of time that the light-emitting device has emitted light since it was attached to the light-emission controlling apparatus, or counting the number of times that the light-emitting device has emitted light since it was attached to the light-emission controlling apparatus. Therefore, the light-emission controlling apparatus can cause the light-emitting device to emit light in a light-emission mode selected according to either the measured light-emission integrated time or the counted light-emission number of times. Thus the light-emission state of the light-emitting device can be controlled more finely.

In accordance with another preferred embodiment of the present invention, the light-emission controlling apparatus can select one light-emission mode according to which one of the integral of the length of time that the light-emitting device has emitted light, the number of times that the light-emitting device has emitted light, the light intensity of the light-emitting device, and so on, exceeds the corresponding reference value, and cause the light-emitting device to emit light in the selected light-emission mode to generate a warning. Therefore, the user can easily determine which one of the plural pieces of information such as the integrated light-emission time, the light-emission number of times, the light intensity, and so on, each of which shows the light-emission state of the light-emitting device, generated the warning, on the basis of, for example, a number of times that the light-emitting device had flashed on and off.

Many widely different embodiments of the present invention may be constructed without departing from the spirit and scope of the present invention. It should be understood that the present invention is not limited to the specific embodiments described in the specification, except as defined in the appended claims.

What is claimed is:

1. A light-emission controlling apparatus comprising:

a light-emitting means for emitting light;

a detecting means for detecting a light-emission state of said light-emitting means; and a control means for selecting one from at least a first light-emission mode and a second light-emission mode according to the light-emission state of said light-emitting means detected by said detecting means, and for enabling said light-emitting means to emit light in the selected first or second light-emission mode, wherein said detecting means detects the light-emission state of said light-emitting means by acquiring plural pieces of information each showing how long or how many times said light-emitting means has been used, and wherein said control means selects one from among a plurality of light-emission modes according to the plural pieces of information acquired by said detecting means, and for enabling said light-emitting means to emit light in one said light-emission mode selected.

2. A light-emission controlling apparatus comprising:

a light-emitting means for emitting light;

a detecting means for detecting a light-emission state of said light-emitting means; and a control means for selecting one from at least a first light-emission mode and a second light-emission mode according to the light-emission state of said light-emitting means detected by said detecting means, and for enabling said light-emitting means to emit light in the selected first or second light-emission mode, wherein said control means includes a comparing means for comparing the light-emission state of said light-emitting means detected by said detecting means to a reference light-emission state of said light-emitting means, and a light-emission mode selecting means for selecting either the first light-emission mode or the second light-emission mode according to a comparison result from said comparing means, and wherein said detecting means detects the light-emission state of said light-emitting means by acquiring information showing how long or how many times said light-emitting means has been used.

3. The light-emission controlling apparatus according to claim 2, wherein said detecting means includes a means for measuring the integral of the length of time that said light-emitting means has emitted light since it was attached to said light-emission controlling apparatus, and said comparing means compares the measured integral of the length of time that said light-emitting means has emitted light to a reference value showing the reference light-emission state of said light-emitting means, and wherein said light-emission mode selecting means selects the second light-emission mode when the comparison result indicates that the measured integral of the length of time that said light-emitting means has emitted light is greater than the reference value, and said light-emission mode selecting means selects the first light-emission mode otherwise.

4. The light-emission controlling apparatus according to claim 2, wherein said detecting means includes a means for measuring the number of times that said light-emitting means has emitted light since it was attached to said light-emission controlling apparatus, and said comparing means compares the measured number of times that said light-emitting means has emitted light to a reference value showing the reference light-emission state of said light-emitting means, and wherein said light-emission mode selecting means selects the second light-emission mode when the comparison result indicates that the measured number of times that said light-emitting means has emitted light is greater than the reference value, and said light-emission mode selecting means selects the first light-emission mode otherwise.

5. The light-emission controlling apparatus according to claim 2, wherein said detecting means further includes a means for measuring the number of times that said light-emitting means has emitted light since it was attached to said light-emission controlling apparatus, and said comparing means further compares the measured number of times that said light-emitting means has emitted light to another reference value showing the reference light-emission state of said light-emitting means, and wherein said light-emission mode selecting means selects the second light-emission mode when the comparison result indicates that the measured integral of the length of time that said light-emitting means has emitted light is greater than the reference value but the measured number of times that said light-emitting means has emitted light is lower than or equal to said another reference value, said light-emission mode selecting means selects a third light-emission mode when the comparison result indicates that the measured number of times that said light-emitting means has emitted light is greater than said another reference value, and said light-emission mode selecting means selects the first light-emission mode otherwise.

6. The light-emission controlling apparatus according to claim 1, wherein when said light-emission mode selecting means selects the first light-emission mode, said control means enables said light-emitting means to simply light up, and when said light-emission mode selecting means selects the second light-emission mode, said control means enables said light-emitting means to flash on and off during a predetermined period of time.

7. The light-emission controlling apparatus according to claim 1, wherein when said light-emission mode selecting means selects the first light-emission mode, said control means enables said light-emitting means to simply light up, and when said light-emission mode selecting means selects the second light-emission mode, said control means enables said light-emitting means to flash on and off only a predetermined number of times.

8. A light-emission controlling apparatus comprising:

a light-emitting means for emitting light; and a means for determining whether or not a time to replace said light-emitting means has come so as to select a first light-emission mode when determining that a time to replace said light-emitting means has not come and select a second light-emission mode when determining that a time to replace said light-emitting means has come, and for enabling said light-emitting means to emit light in the selected first or second light-emission mode, wherein said determining means includes a means for measuring the integral of the length of time that said light-emitting means has emitted light since it was attached to said light-emission controlling apparatus, a comparing means for comparing the measured integral of the length of time that said light-emitting means has emitted light to a reference value, and a light-emission mode selecting means for selecting either the first light-emission mode or the second light-emission mode according to a comparison result from said comparing means.

9. The light-emission controlling apparatus according to claim 8, wherein said determining means includes a means for measuring or counting the number of times that said light-emitting means has emitted light since it was attached to said light-emission controlling apparatus, a comparing means for comparing the measured number of times that said light-emitting means has emitted light to a reference value, and a light-emission mode selecting means for selecting either the first light-emission mode or the second light-emission mode according to a comparison result from said comparing means.

10. A light-emission controlling apparatus comprising:

a light-emitting means for emitting light; and a means for determining whether or not a time to replace said light-emitting means has come so as to select a first light-emission mode when determining that a time to replace said light-emitting means has not come and select a second light-emission mode when determining that a time to replace said light-emitting means has come, and for enabling said light-emitting means to emit light in the selected first or second light-emission mode, wherein when said light-emission mode selecting means selects the first light-emission mode, said control means enables said light-emitting means to simply light up, and when said light-emission mode selecting means selects the second light-emission mode, said control means enables said light-emitting means to flash on and off during a predetermined period of time.

11. The light-emission controlling apparatus according to claim 10, wherein when said light-emission mode selecting means selects the first light-emission mode, said control means enables said light-emitting means to simply light up, and when said light-emission mode selecting means selects the second light-emission mode, said control means enables said light-emitting means to flash on and off only a predetermined number of times.

* * * * *